US007350993B2

(12) United States Patent
Hirabayashi

(10) Patent No.: US 7,350,993 B2
(45) Date of Patent: Apr. 1, 2008

(54) PAPER STORAGE APPARATUS, AND A PAPER PROCESSING APPARATUS HAVING A PAPER STORAGE APPARATUS

(75) Inventor: Kenichi Hirabayashi, Shiojin (JP)

(73) Assignee: Seiko Epson Corporation (JP)

( * ) Notice: Subject to any disclaimer, the term of this patent is extended or adjusted under 35 U.S.C. 154(b) by 248 days.

(21) Appl. No.: 10/989,391

(22) Filed: Nov. 15, 2004

(65) Prior Publication Data

US 2005/0129441 A1 Jun. 16, 2005

(30) Foreign Application Priority Data

Nov. 14, 2003 (JP) ..... 2003-385401
Nov. 14, 2003 (JP) ..... 2003-385402

(51) Int. Cl.
*B41J 13/00* (2006.01)

(52) U.S. Cl. ..... 400/642; 271/271; 399/405

(58) Field of Classification Search ..... 101/232; 400/642, 645, 645.4, 647.1, 708; 399/403, 399/404, 405; 271/264, 267, 271
See application file for complete search history.

(56) References Cited

U.S. PATENT DOCUMENTS 6,257,783 B1 7/2001 Hanaoka et al.

FOREIGN PATENT DOCUMENTS

| | | |
|---|---|---|
| JP | 09-136735 | 5/1997 |
| JP | 09-136752 | 5/1997 |
| JP | 2000-344428 | 12/2000 |
| JP | 2003-217000 | 7/2003 |

*Primary Examiner*—Ren Yan
(74) *Attorney, Agent, or Firm*—Anderson Kill & Olick, PC

(57) ABSTRACT

A paper storage apparatus for stacking and storing paper in sequence comprising a first discharge roller 21 for discharging paper (check S1) in a specified discharge direction; a paper storage pocket (check storage pocket 12) for stacking the paper at a position offset from the specified direction in which the check S1 is transported by the first discharge roller 21, a movable first guide member (paper guide 60) having a first position disposed at an inclined angle relative to the direction the check S1 is discharged by the first discharge roller 21, for guiding the check S1 into the storage pocket 12, and a second position displaced from the first position for applying pressure upon the check(s)in the check storage pocket 12 and a movable second guide member (paper shift lever) 40 positioned between the first discharge roller 21 and first guide member (paper guide 60) which pivots from a first position in response to the leading edge of the paper to allow the paper to advance into a second position for urging the trailing edge of the paper toward the movable second guide member.

10 Claims, 17 Drawing Sheets

PAPER STORAGE APPARATUS, AND A PAPER PROCESSING APPARATUS HAVING A PAPER STORAGE APPARATUS

BACKGROUND OF THE INVENTION

1. Field of the Invention

The present invention relates to a paper storage apparatus disposed to the discharge section of a paper processing apparatus for collecting paper documents processed in the paper processing apparatus that handles documents for one or both of reading data from the documents and writing data to the documents. The invention also relates to a paper processing apparatus including this paper storage apparatus.

2. Description of Related Art

A paper tray for accumulating processed documents is generally disposed to the paper discharge section of printers and other types of paper processing apparatuses so that papers discharged substantially horizontally from the paper processing apparatus are stacked sequentially on the tray.

Paper processing apparatuses used to process relatively stiff paper documents such as checks, however, often convey and process the papers in a substantially vertical posture.

A paper storage apparatus that stacks and stores documents in such a vertical posture is generally configured as shown in FIG. 17. This paper storage apparatus 100 has a discharge roller pair 101 and a paper storage unit 102.

The discharge roller pair 101 includes a feed roller 101A and a pressure roller 101B, and is disposed to the paper discharge section of the paper processing apparatus. This discharge roller pair 101 holds paper S in a substantially vertical posture and conveys the paper S horizontally to the paper storage unit 102.

The paper storage unit 102 has a paper storage pocket 103 and a paper guide 104 diagonal to a paper transportation path L1. The paper storage pocket 103 is offset laterally to the paper transportation path L1 for stacking papers S in a substantially vertical posture. The paper guide 104 is disposed at an angle to the paper transportation path L1 for guiding the papers S into the paper storage pocket 103.

Paper S conveyed in a line through the paper transportation path L1 by the discharge roller pair 101 thus contacts the paper guide 104, is directed thereby into the paper storage pocket 103, and is thus stacked in the paper storage pocket 103.

A problem with this configuration is that when a folded or wrinkled paper is processed, the fixed paper guide 104 in line with the paper transportation path L1 may not be sufficient to ensure that the papers are stacked normally in the paper storage pocket 103. If multiple papers S are discharged in succession and the trailing edge of a first paper S intercedes in the path of the following paper S, the papers S may become entangled or jammed, or the papers S may not be stacked in the order processed. This is particularly a problem when the papers S are checks because checks often become folded or wrinkled during use and handling.

SUMMARY OF THE INVENTION

The paper storage apparatus and paper processing apparatus of the present invention can reliably stack papers S in the correct order even when the papers S have been folded or wrinkled.

The paper storage apparatus according to the present invention comprises a first discharge roller for conveying and discharging paper; a paper storage pocket for stacking the paper at a position offset from the direction in which the first discharge roller discharges paper (the "paper discharge direction"); and a movable first guide member having a first position for guiding the paper into the paper storage pocket with the first position being inclined to the paper discharge direction of the first discharge roller, and having a second position displaced from the paper discharge direction.

When the leading edge of a paper advanced by the first discharge roller contacts the first guide member in the first position, the paper is guided into the paper storage pocket and stacked in the paper storage pocket. When the paper discharge operation is completed, the first guide member is moved from the first position to the second position, thereby reliably pressing the bundle of paper stacked in the paper storage pocket and preventing the bundle from coming apart.

The paper storage apparatus preferably includes a movable second guide member positioned between the first discharge roller and first guide member having a first position intersecting the transportation direction of the first discharge roller, and a second position retracted from the transportation direction and disposed to a side on which the paper storage pocket is located for urging the trailing edge of the paper toward the paper storage pocket.

The second guide member is moved from the second position to the first position each time the trailing edge of the paper is advanced by the first discharge roller so that the trailing edge of the paper can be reliably guided into the paper storage pocket when the leading edge of a succeeding paper is advanced by the first discharge roller. As a result, paper that has been folded or wrinkled can be smoothly stacked in the paper storage pocket without the paper jamming or catching other paper, and the paper can be sequentially stacked in the same order in which the paper was discharged.

The position of the first and second guide members is preferably changed by means of a linking mechanism according to the position of a first pressure member that is disposed opposite the first discharge roller and is displaceable to a pressure position for pressing the paper to the first discharge roller and a retracted position separated from the discharge roller. The linking mechanism sets the first guide member to the first position and sets the second guide member to the first position when this first pressure member is in the pressure position, and sets the first guide member to the second position and sets the second guide member to the second position when the first pressure member is in the retracted position.

This linking mechanism comprises a first urging member for urging the first guide member toward the second position; a second urging member for urging the second guide member toward the first position; and a first lever member having a first arm that contacts the first guide member, a second arm that contacts the second guide member, and a pivot center disposed between the first and second arms. The linking mechanism is arranged so that the first guide member is positioned to the first position and the second guide member is positioned to the first position in conjunction with the first lever member pivoting in a first direction; and the first guide member is positioned to the second position and the second guide member is positioned to the second position in conjunction with the first lever member pivoting in a second direction opposite from the first direction.

The linking mechanism further comprises a second lever member having a third arm that contacts the second arm of the first lever member, a fourth arm linked to an actuator, and a pivot center disposed between the third and fourth arms. This linking mechanism is arranged so that the first pressure member is supported by the third arm, and when the actuator is operated so that (i) when the second lever member pivots in the third direction, the first pressure member is positioned to the pressure position and the first lever member pivots in the first direction, and (ii) when the second lever pivots in a fourth direction opposite the third direction, the first pressure member is positioned to the retracted position and the first lever member pivots in the second direction.

As a result, displacing the first guide member can be linked to displacing the first pressure member. When paper is discharged, the first guide member is set to the first position to guide the leading edge of paper into the paper storage pocket, and after the paper is discharged, the first guide member is reset from the first position to the second position, thus guiding and holding the trailing portion of the paper in the paper storage pocket.

Changing the position of the second guide member is linked to displacing the first pressure member and to the paper discharge operation. More specifically, displacing the second guide member from the first position to the second position in resistance to the urging force of the second urging member is enabled by contact with the discharged paper, and displacement from the second position to the first position is enabled by the urging force of the second urging member when the paper is discharged because paper is released and no longer nipped.

Furthermore, by linking the opening and closing operation of the first pressure member with the displacing operation of the first and second guide members, a single drive source can be used for both operations, and control can be simplified.

This paper storage apparatus further preferably has a second discharge roller located downstream of the first discharge roller with a plurality of ribs on the outside circumferential surface of the second discharge roller.

Yet further preferably, a second pressure member is disposed on the second arm of the first lever member, and is positioned opposite the second discharge roller as a result of the first lever member pivoting in the first direction.

Yet further preferably, the second pressure member has flanges formed to overlap both end portions of the ribs of the second discharge roller when the second pressure member is positioned opposite the second discharge roller.

Paper can thus be reliably advanced and discharged as a result of the ribs on the second discharge roller pushing on the trailing edge of the paper. Furthermore, the second guide member can reliably move the trailing end portion of the paper released from the discharge roller into the paper storage pocket.

The paper storage pocket preferably comprises first and second side walls that are mutually opposing and substantially parallel to the paper discharge direction, the second side wall being positioned on the discharge roller side; a bottom wall joining the first and second side walls; and a paper support member disposed between the first and second side walls and urged to the second wall side.

Paper stacked in the paper storage pocket can thus be held between the paper support member, and the second side wall and the first guide member positioned to the second position. The paper is thus reliably stacked sequentially in the same order in which it was discharged, and the order is thus prevented from changing.

The paper processing apparatus of the present invention includes a paper storage apparatus as described above, a first transportation path for conveying a first paper; a second transportation path for conveying a second paper; and an opening rendered along the second transportation path for inserting the second paper into the second transportation path. The first discharge roller is disposed to the first transportation path and discharges the first paper conveyed through the first transportation path. The first transportation path and second transportation path overlap substantially perpendicularly in a part thereof near the first discharge roller. When inserting the second paper from the opening, the first pressure member is set to the retracted position, and the first guide member is set to the second position and the second guide member is set to the second position by means of the linking mechanism, to prevent interference with inserting the second paper.

BRIEF DESCRIPTION OF THE DRAWINGS

Other advantages of the present invention together with a fuller understanding of the invention will become apparent and appreciated by referring to the following description and claims taken in conjunction with the accompanying drawings of which:

DESCRIPTION OF THE PREFERRED EMBODIMENTS

A preferred embodiment of a paper processing apparatus having a paper storage apparatus according to the present invention is described below with reference to the accompanying figures.

Figure 1:
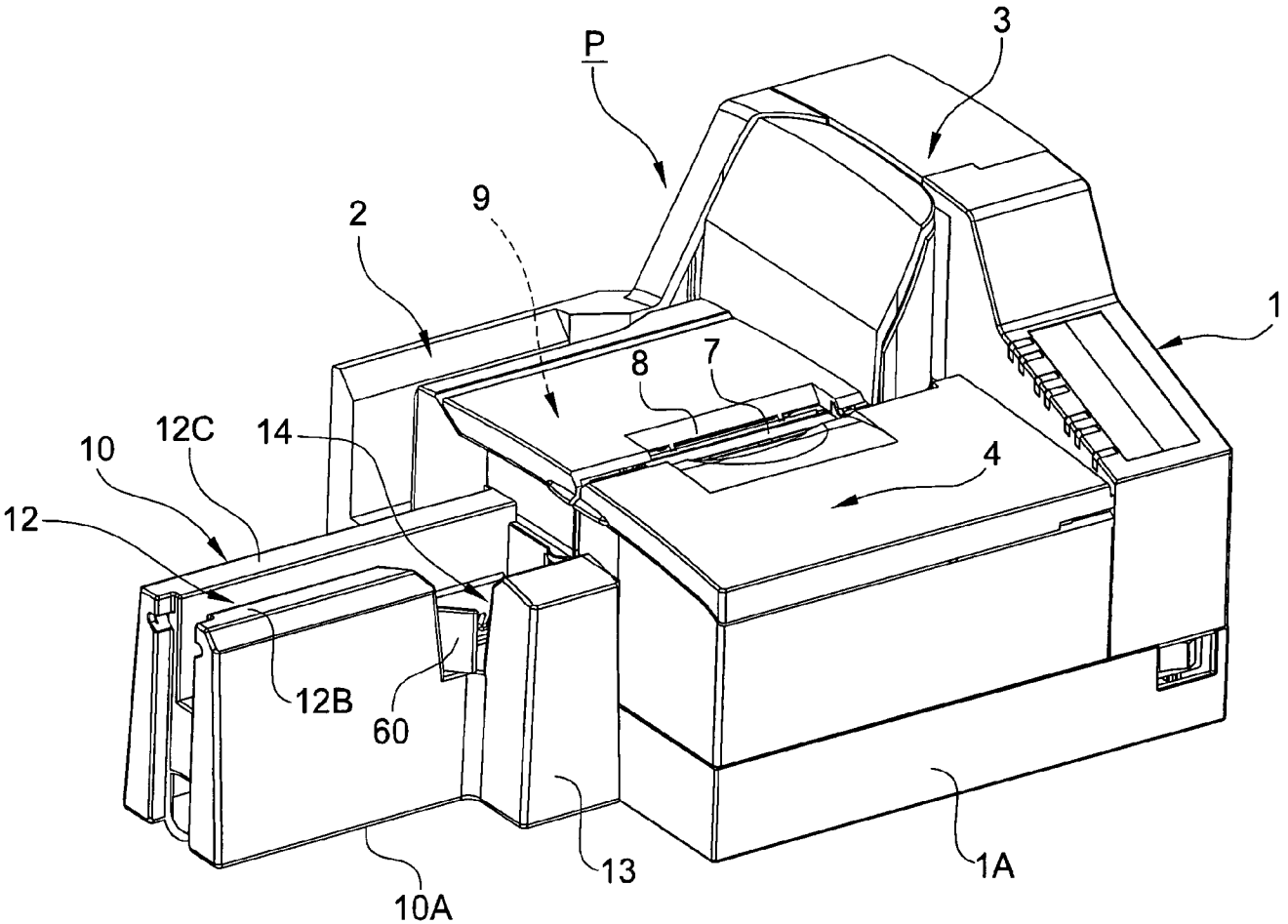
FIG. 1 is an oblique overview of a paper processing apparatus having a paper storage apparatus according to a preferred embodiment of the invention.
Figure 2:
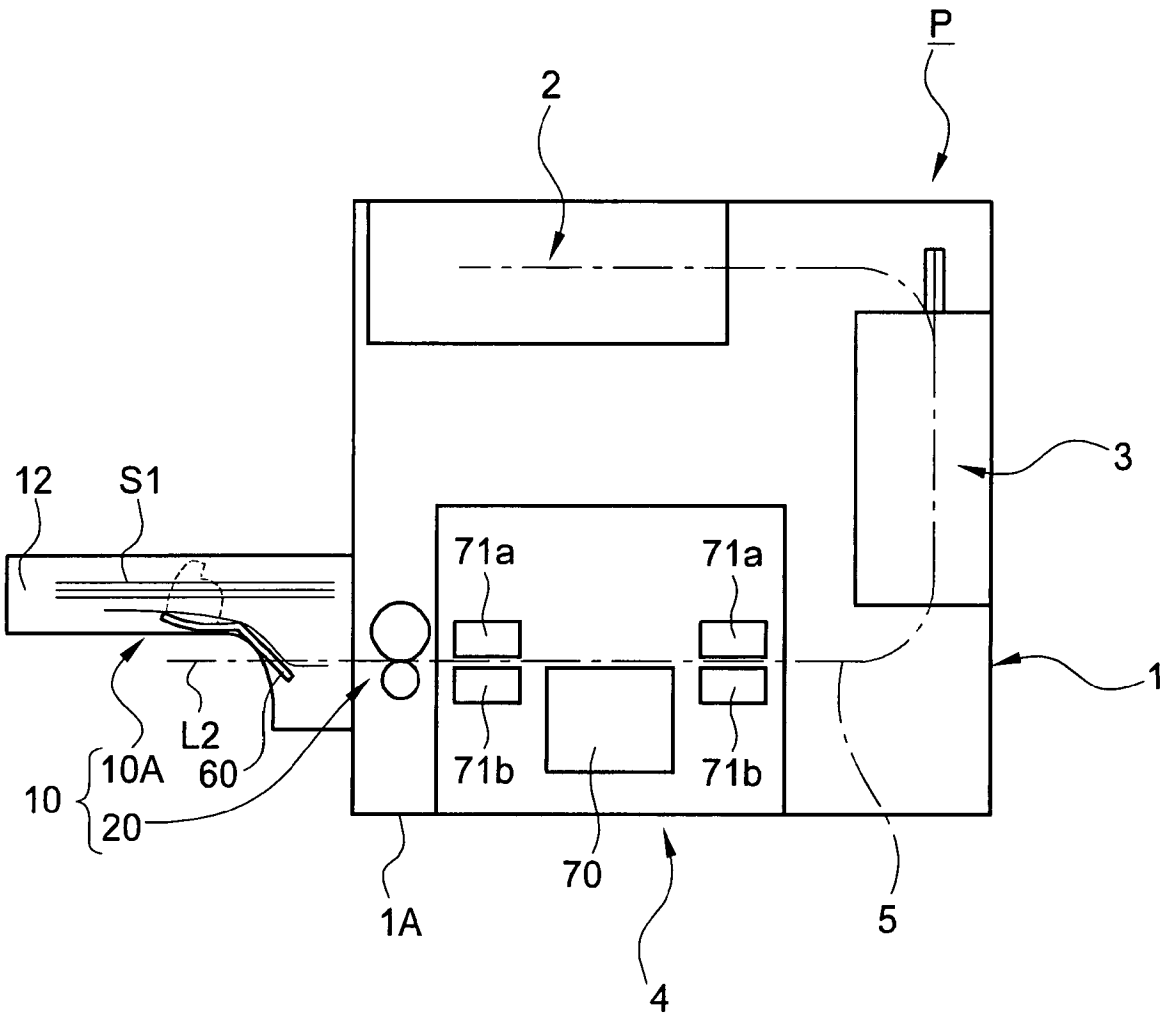
FIG. 2 is a schematic plan view showing major parts of the paper processing apparatus shown in FIG. 1.

A document processor P (paper processing apparatus) according to this embodiment of the invention is particularly suited to processing checks, and as shown in FIG. 1 and FIG. 2, has a paper supply unit 2, data reader (scanner) 3, and printer 4 disposed inside a case 1A of a main unit 1. A paper storage apparatus (unit) 10 according to the present invention is disposed to the side wall of the discharge section of the main unit 1.

The paper storage apparatus 10 includes a discharged paper unit 10A that can be freely attached to and removed from the case 1A, and a discharge roller unit 20 rendered in the main unit 1.

The paper supply unit 2 is disposed to the entrance part of an U-shaped first transportation path 5, the data reader 3 is disposed to the middle of the first transportation path 5, and the printer 4 is disposed to the exit part of the first transportation path 5.

As a check S1 (first paper) delivered from the paper supply unit 2 is conveyed standing on edge in a vertical posture through the first transportation path 5, the data reader 3 reads data recorded on the check S1, and the printer 4 prints to the check as needed. After the check S1 is processed, it is discharged by the discharge roller unit 20 and stored in the discharged paper unit 10A. The discharge roller unit 20 delivers the check S1 horizontally in a vertical posture, and the discharged paper unit 10A accumulates the discharged checks S1 with the checks S1 standing vertically on edge.

Figure 3:
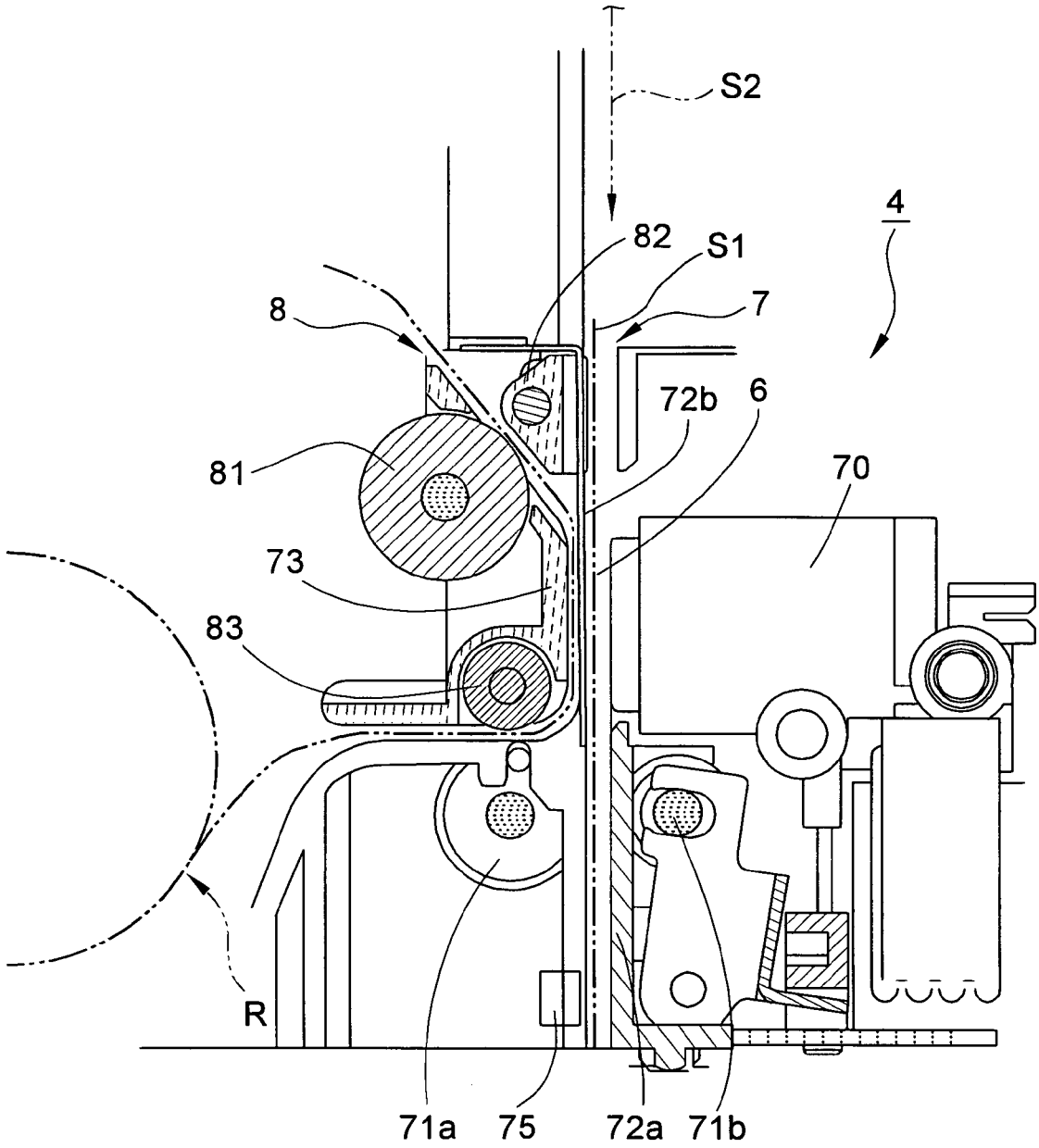
FIG. 3 is a schematic section view showing the printing device in this paper processing apparatus.

As shown in FIG. 3, the printer 4 has a print head 70 disposed to the printing position adjacent to the first transportation path 5 and a second transportation path 6 rendered substantially perpendicularly to the first transportation path 5. The second transportation path 6 is formed between an outside guide 72*a* and an inside guide 72*b*, and transports slips S2 (second paper) such as validation slips that are inserted from a top opening 7 formed in the top of the document processor P. Insertion of a slip S2 to the second transportation path 6 is detected by a paper detector 75 disposed near the bottom of the second transportation path 6.

A drive roller 71*a* and pressure roller 71*b* are disposed in mutual opposition on opposite sides of the second transportation path 6 for conveying a slip S2 in the vertical direction. The drive roller 71*a* is located below a platen 73 and tension roller 83 further described below. The pressure roller 71*b* is movable by means of an actuator to a transportation position where the pressure roller 71*b* contacts the drive roller 71*a*, and a retracted position separated from the drive roller 71*a*. When a check S1 is conveyed through the first transportation path 5, and when a slip S2 is inserted from the top opening 7, the pressure roller 71*b* is in the retracted position.

When a slip S2 is inserted from the top opening 7 to the second transportation path 6 and is detected by the paper detector 75, the pressure roller 71*b* is moved from the retracted position to the transportation position, thus holding the slip S2 between the pressure roller 71*b* and drive roller 71*a*. The drive roller 71*a* is then turned to convey the slip S2 upwardly to the top opening 7. The slip S2 is printed by the print head 70 during this time and then discharged from the top opening 7.

The printer 4 also has a roll paper transportation mechanism including a drive roller 81 for conveying roll paper R vertically, a pressure roller 82 for pressing the roll paper R to the drive roller 81, and the tension roller 83 for applying specific tension to the roll paper R. The roll paper R transportation path shares part of the second transportation path 6, and similarly to the second transportation path 6 conveys the roll paper R substantially perpendicularly to the first transportation path 5. Roll paper R is held in a roll paper compartment 9, is printed by the print head 70 while conveyed through the roll paper transportation path, and is discharged from a roll paper exit 8.

Figure 4:
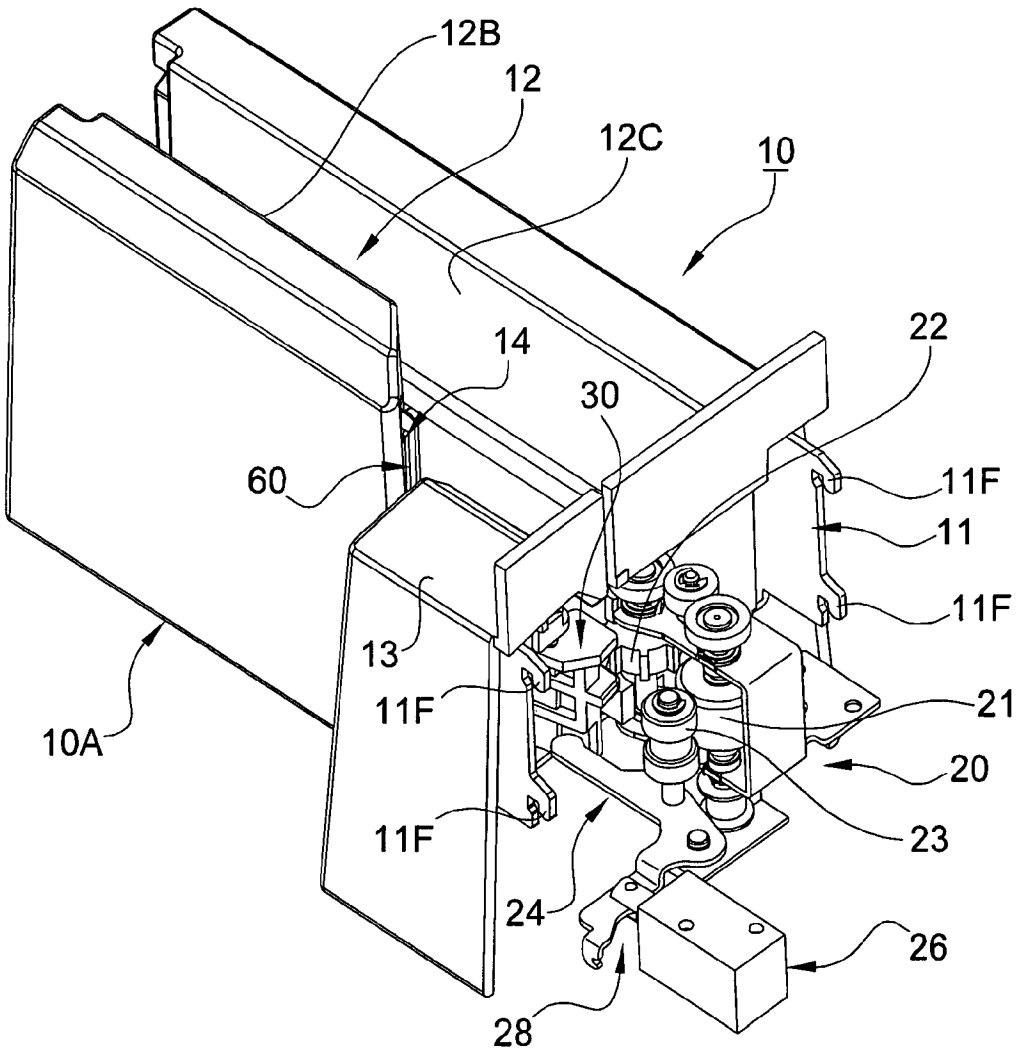
FIG. 4 is an oblique schematic view of the paper storage apparatus in a preferred embodiment of the invention.
Figure 5:
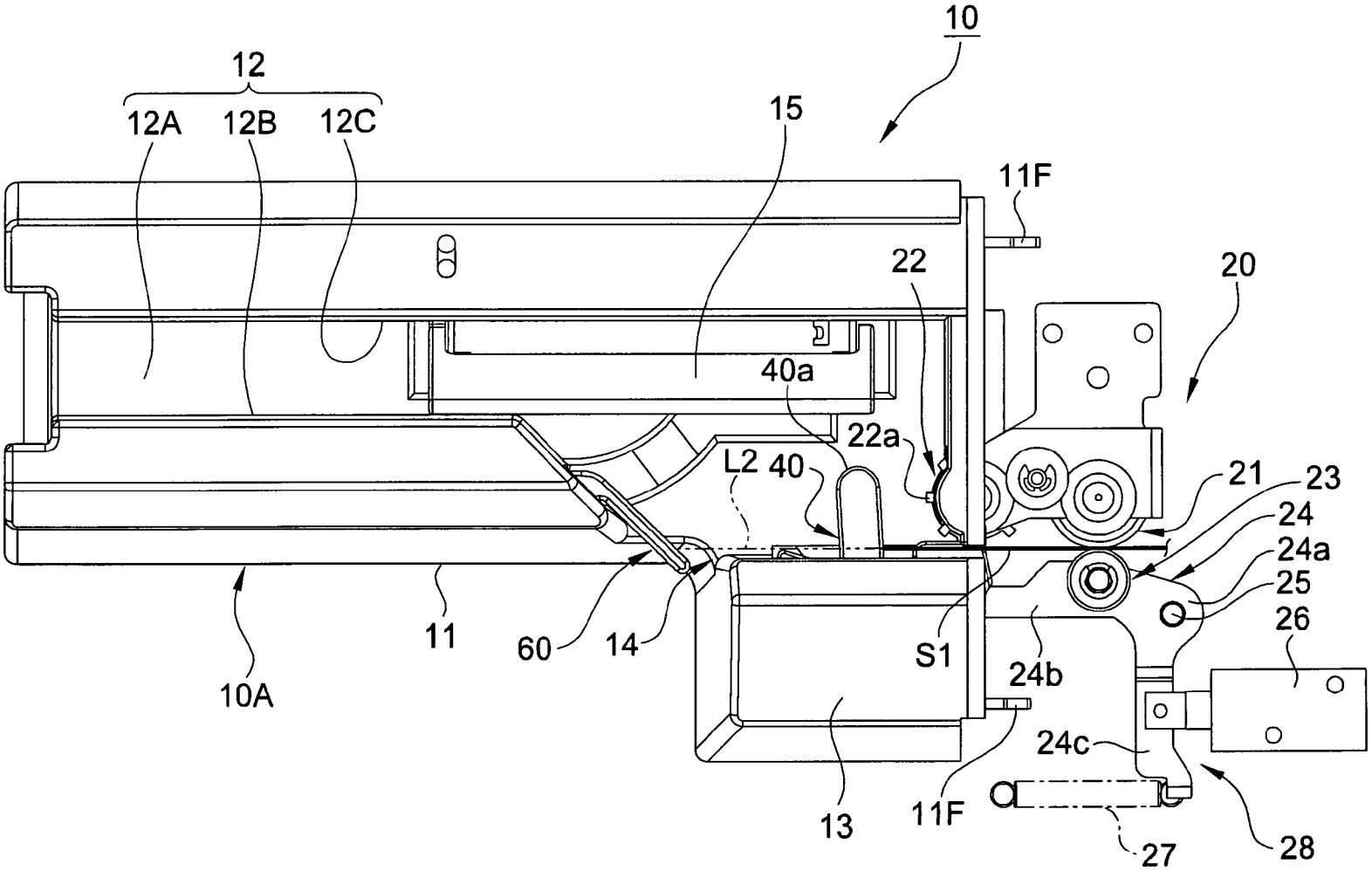
FIG. 5 is a plan view of the paper storage apparatus when a paper document has been conveyed into the paper discharge unit.
Figure 6:
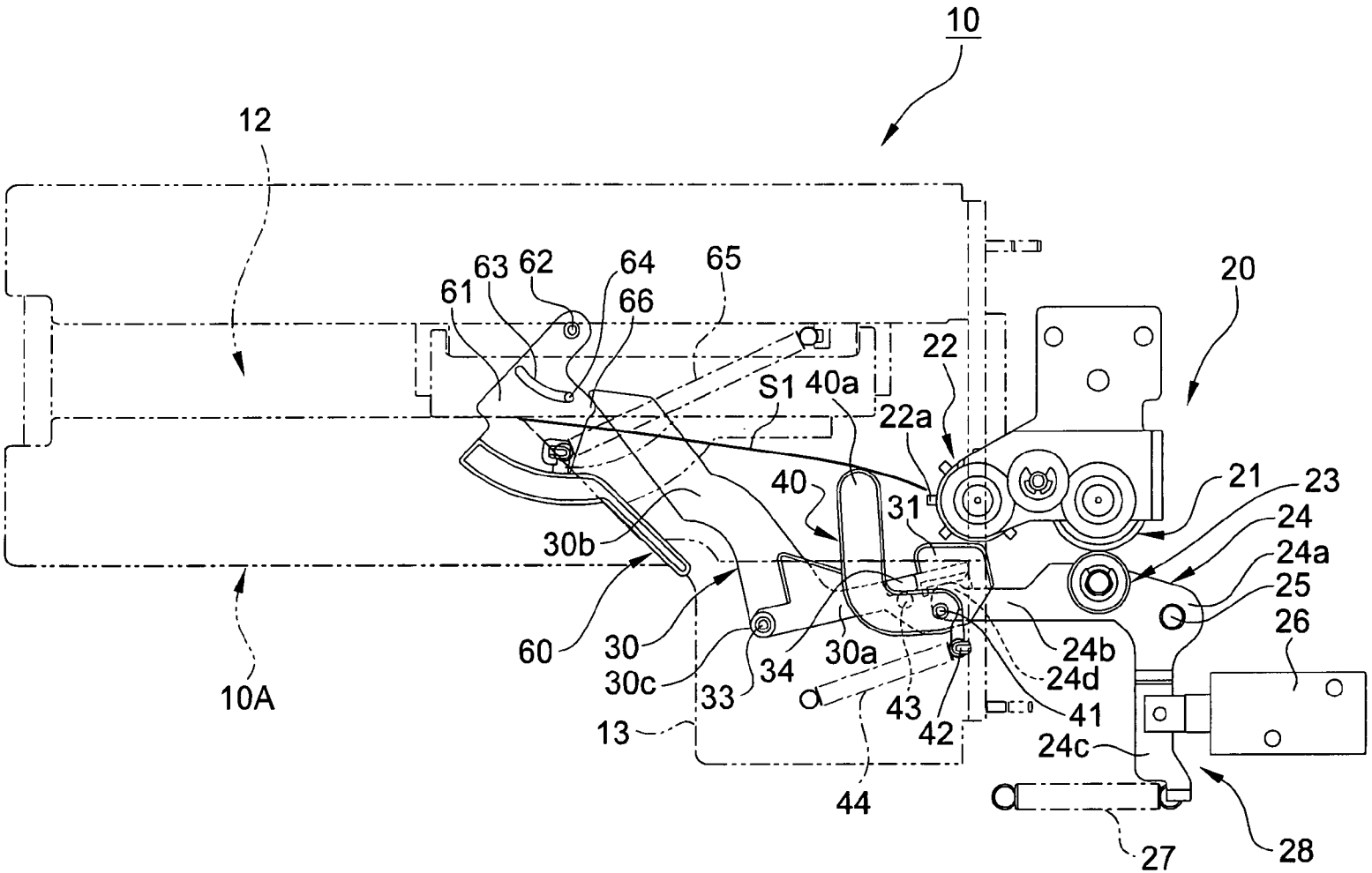
FIG. 6 is a plan view showing the internal configuration of the paper storage apparatus.

As shown in FIG. 4 to FIG. 6, a check storage pocket (paper storage pocket) 12 is disposed to a frame 11 of the discharged paper unit 10A at a position offset laterally to a paper transportation path (direction) L2 of the discharge roller unit 20. This check storage pocket 12 is for stacking the checks S1 sequentially delivered from the discharge roller unit 20 with the checks standing vertically on edge. The check storage pocket 12 has a bottom 12A (bottom wall) and two side walls 12B, 12C.

A pressure member 15 (paper support member) is disposed inside the check storage pocket 12. The bottom portion of the pressure member 15 is supported rotatably and the pressure member 15 is urged by a torsion spring (elastic member) not shown from one side wall 12C (first wall) to the other side wall 12B (second wall). The position of the pressure member 15 is thus adjustable according to the volume of checks S1 in the check storage pocket 12.

The side walls 12B, 12C are parallel to the paper transportation path L2 with one side wall 12B located near the paper transportation path L2 and the other side wall 12C located farther away from the paper transportation path L2. The side wall 12B that is near the paper transportation path L2 is present only downstream of a paper guide 60 (described below) in the transportation direction, and is thus not present in the area near the discharge roller unit 20. More specifically, the paper guide 60 is rendered at a position separated, some distance from the discharge area of the discharge roller unit 20, and the side wall 12B is located only on the downstream side of the paper guide 60 in the transportation direction. The other side wall 12C extends substantially to the same position as the discharge area of the discharge roller unit 20.

Four hooks 11F are formed at one end of the frame 11 of the discharged paper unit 10A. The discharged paper unit 10A is assembled to the main unit 1 by engaging these four hooks 11F with matching holes (not shown) in the main unit 1. When the discharged paper unit 10A is mounted to the main unit 1, the mechanical part of the discharged paper unit 10A is combined with the discharge roller unit 20 of the main unit 1.

The discharge roller unit 20 includes a first discharge roller 21 and a second discharge roller 22. Operation of the first discharge roller 21 and second discharge roller 22, which rotate synchronously in the paper transportation direction, is linked to the operation of other parts of the main unit 1.

The second discharge roller 22 is located downstream in the paper transportation direction from the first discharge roller 21, and as further described below conveys the check S1 by means of ribs 22*a* protruding from the outside roller surface pushing the trailing edge of the check S1.

The discharge roller unit 20 also has a pressure roller 23 (first pressure member) disposed opposite the first discharge roller 21. This pressure roller 23 presses a check S1 to the first discharge roller 21, and is axially supported to rotate freely on a first pressure lever 24 (second lever member).

When seen in a plan view, the first pressure lever 24 is substantially L-shaped with two arms 24*b*, 24*c*. A pin 25 at the elbow 24*a* supports the first pressure lever 24 pivotally within a horizontal plane to the frame of the main unit 1. The first arm 24*b* and second arm 24*c* extend from the elbow 24*a* in substantially mutually perpendicular directions, the first arm 24*b* rendered substantially parallel to the paper transportation path L2 with the distal end thereof pointing downstream in the transportation direction, and the second arm 24*c* rendered with the distal end thereof substantially perpendicular to the paper transportation path L2.

The pressure roller 23 is rotatably disposed to the middle portion of the first arm 24*b*, and the operating end of a solenoid 26 (actuator) for driving the first pressure lever 24 is linked to the middle portion of the second arm 24*c*. A first spring 27 is engaged with the distal end of the second arm 24*c*. This first spring 27 rotationally urges the first pressure lever 24 in the direction causing the pressure roller 23 to contact the first discharge roller 21.

The force of this first spring 27 thus normally rotationally urges the first pressure lever 24, causing the pressure roller 23 to apply pressure to the first discharge roller 21. When the solenoid 26 is energized and operated, the solenoid 26 causes the first pressure lever 24 to rotate in the opposite direction in opposition to the force of the first spring 27, thereby separating the pressure roller 23 from the first discharge roller 21.

It should be noted that this position in which the force of the first spring 27 causes the pressure roller 23 to press against the first discharge roller 21 is the transportation state enabling the first discharge roller 21 to discharge a check S1 through the paper transportation path L2. This relationship between the first discharge roller 21 and pressure roller 23 is referred to below as the "closed" position or state.

In addition, the state in which the operating force of the solenoid 26 separates the pressure roller 23 from the first discharge roller 21 is the open (retracted) position in which the slip S2 can be freely inserted to and removed from the discharge roller unit 20 from the top opening 7. This relationship between the first discharge roller 21 and pressure roller 23 is referred to below as the "open" position or state.

This solenoid 26 and the first pressure lever 24 for transferring the drive force of the solenoid 26 to the pressure roller 23 together form a release mechanism 28. This release mechanism 28 switches the discharge roller unit 20 and a paper shift lever 40 further described below from the transportation position enabling discharging a check S1 to the open position where the slip S2 can be inserted or removed.

Because the first discharge roller 21 and pressure roller 23 are mutually separated in this open position, there is no constraining force acting on a check S1 even if a check S1 is positioned between the rollers 21, 23.

Figure 7:
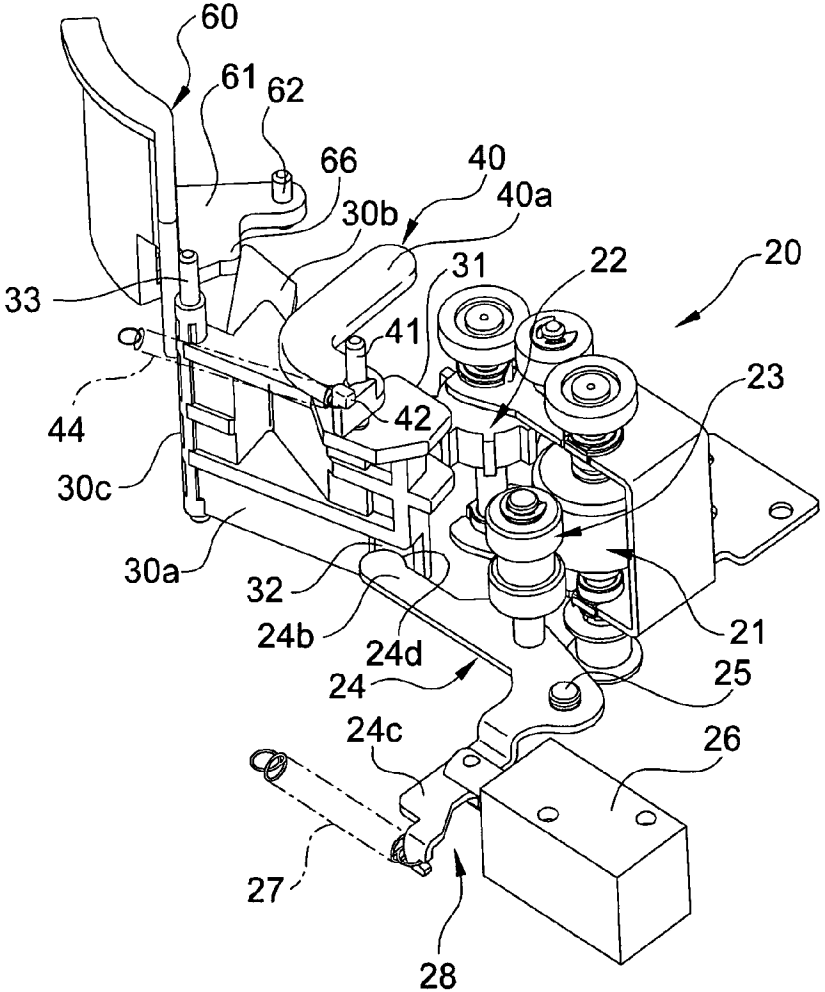
FIG. 7 is an enlarged oblique view of major parts of the paper storage apparatus.
Figure 8:
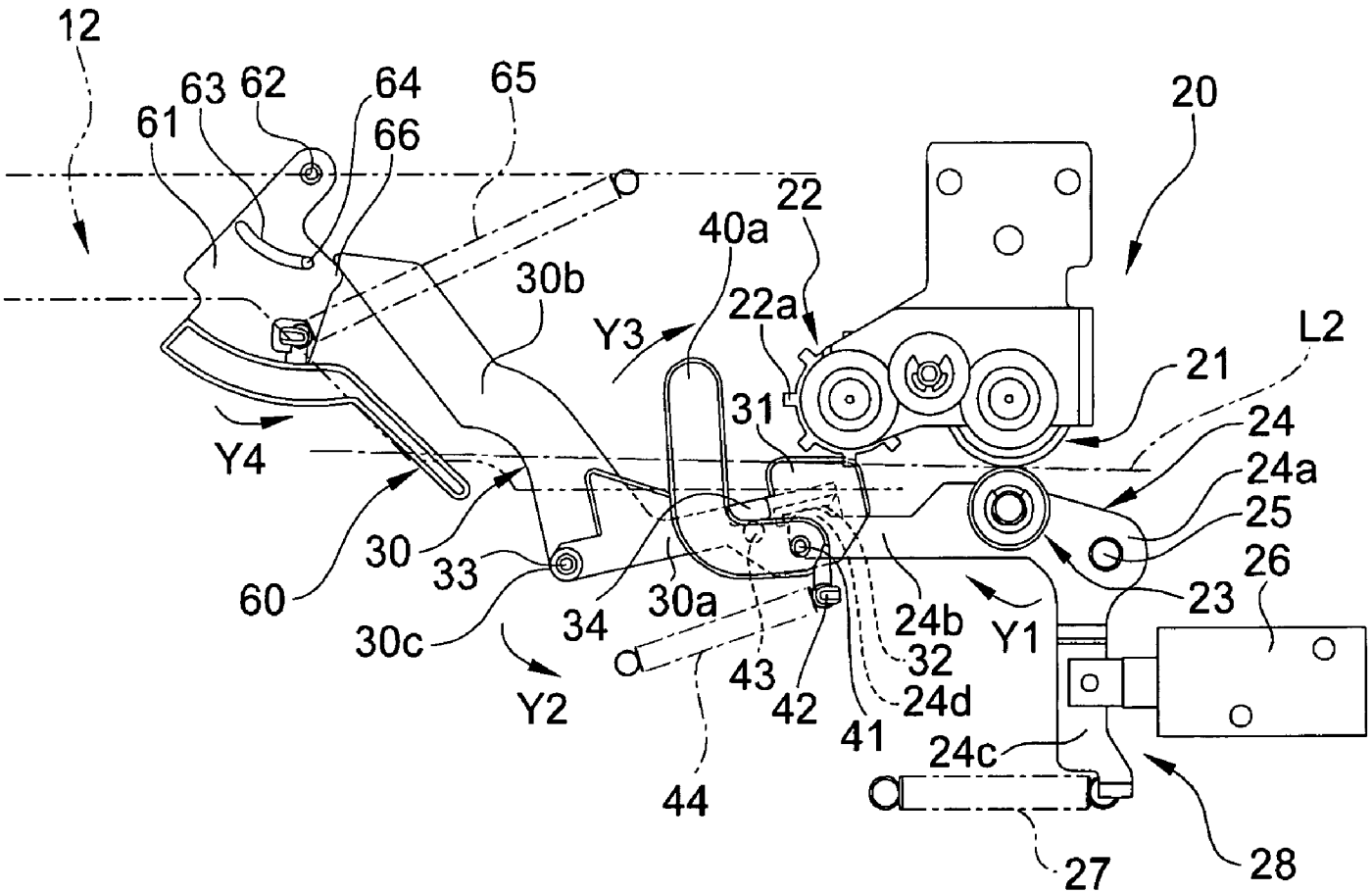
FIG. 8 is an enlarged plan view of major parts of the paper storage apparatus.

As shown in FIG. 7 and FIG. 8, a second pressure lever 30 (first lever member) cooperating with the second discharge roller 22, and the paper shift lever 40 (second guide member) for pushing and urging the trailing edge of the check S1 to the check storage pocket 12, are provided in the discharged paper unit 10A between the paper guide 60 (first guide member) and discharge roller unit 20. The second pressure lever 30 and paper shift lever 40 are housed in a space enclosed by external case 13, and are axially supported to move circularly within a horizontal plane.

Furthermore, a notch 14 (see FIG. 5) positioned in line with the paper transportation path L2 is rendered at the border between the side wall 12B of the check storage pocket 12 and the external case 13 so that horizontally long slips S2 (that is, long in the direction parallel to the first transportation path 5) can be inserted from the top opening 7 to the second transportation path 6.

The second pressure lever 30 is substantially V-shaped when seen in plan view with first and second arms 30*a*, 30*b* (except that the first arm in the claims is 30*b* and the second arm in the claims is 30*a*), and is supported on the frame 11 of the discharged paper unit 10A by a pin 33 at the elbow 30*c* of the V, thus enabling the second pressure lever 30 to rock in a horizontal plane.

The first arm 30*a* extends toward the second discharge roller 22. A paper presser 31 (second pressure member) for pressing a check S1 to the second discharge roller 22 is disposed at the rocking (distal) end of the first arm 30*a*. The second arm 30*b* extends so as to engage a rocking lever 61 of the paper guide 60 in order to move the paper guide 60 circularly.

Furthermore, as shown in FIG. 7, the first arm 30*a* is a rectangular block of a specific width heightwise to the transportation direction of the check S1, and is rendered so as to hold a check S1 on the paper transportation path L2. The second arm 30*b* is a thin plate formed to not interfere with a check S1, and is located below the bottom 12A of the check storage pocket 12.

The paper shift lever 40 is substantially L-shaped in plan view, and is mounted on the frame 11 of the discharged paper unit 10A rotatably through a horizontal plane by means of a pin 41 disposed substantially opposite the second discharge roller 22. The paper shift lever 40 can thus pivot so that the distal end 40*a* of the paper shift lever 40 protrudes toward the check storage pocket 12 and closes the paper transportation path L2, or is retracted from the paper transportation path L2.

Figure 10:
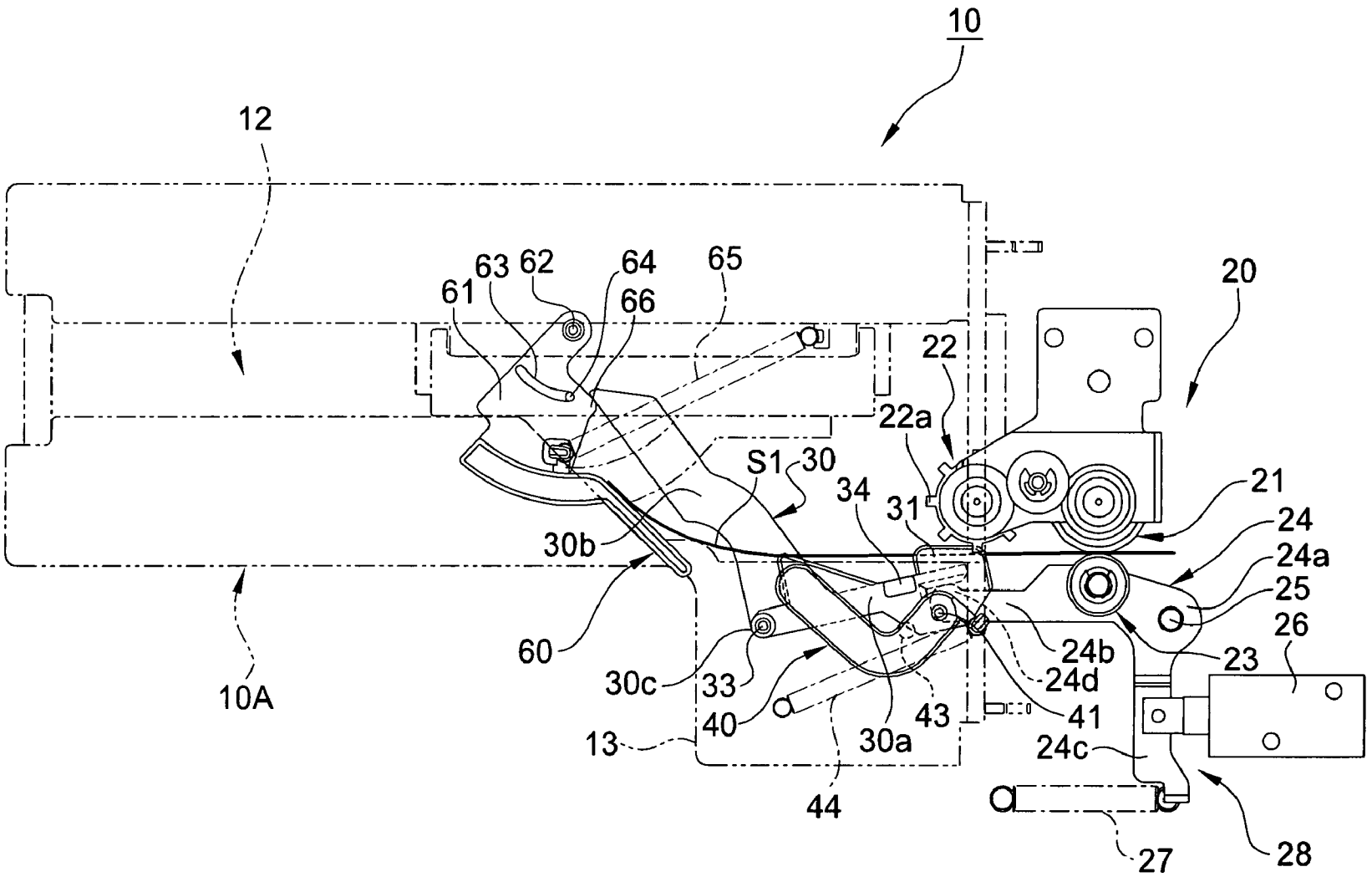
FIG. 10 is a plan view showing the internal configuration of the paper storage apparatus.
Figure 11:
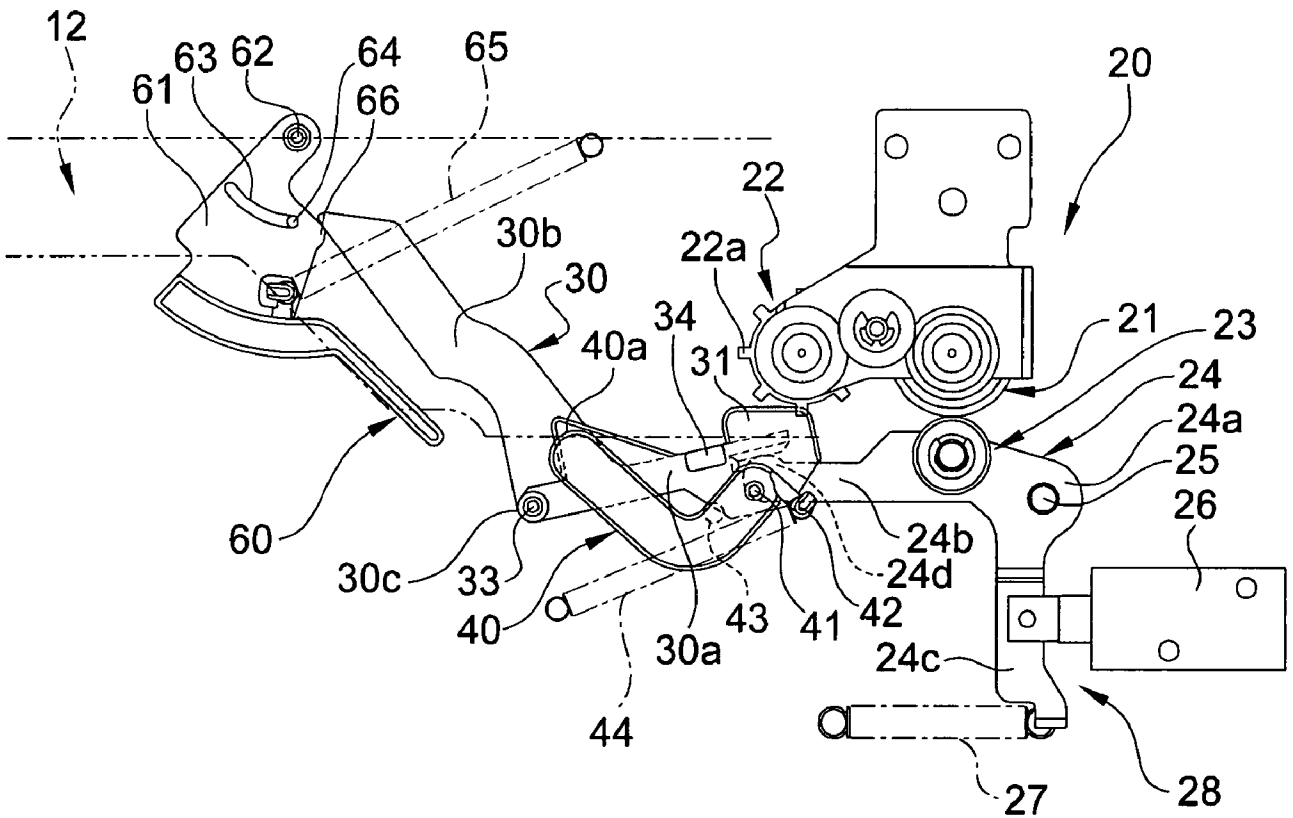
FIG. 11 is an enlarged plan view of major parts in the paper storage apparatus shown in FIG. 9.

An engagement pin 43 and mating receiving portion 34 are disposed to the paper shift lever 40 and the second pressure lever 30 respectively. When the second pressure lever 30 is in the closed position (the paper presser 31 is positioned proximally to the second discharge roller 22), the engagement pin 43 and receiving portion 34 function to restrict the range of rotation of the paper shift lever 40 toward the second discharge roller 22, and to move the paper shift lever 40 to the open position (where the distal end 40*a* is retracted from the paper transportation path L2 as shown in FIG. 10 and FIG. 11) when the second pressure lever 30 pivots to the open position (the paper presser 31 is separated from the second discharge roller 22).

A spring catch 42 is disposed near the pin 41 of the paper shift lever 40. A second spring 44 (second urging member) engaged between the spring catch 42 and frame 11 rotationally urges the distal end 40*a* of the paper shift lever 40 toward the check storage pocket 12 so as to close the paper transportation path L2.

The spring constant of the second spring 44 rendered as an elastic urging member to urge the paper shift lever 40 toward the check storage pocket 12 is set so that the paper shift lever 40 will pivot in the direction in which the distal end 40*a* retracts from the paper transportation path L2 when the paper shift lever 40 is pushed by the leading edge of a check S1 held and conveyed by the first discharge roller 21 and pressure roller 23 of the discharge roller unit 20.

When the leading edge of a check S1 conveyed from the discharge roller unit 20 thus pushes against the paper shift lever 40, the paper shift lever 40 retracts in resistance to the force of the second spring 44 to a position allowing the check S1 to advance passed the paper shift lever 40. When the trailing edge of the check S1 is released by the discharge roller unit 20 and the check S1 is thus pushed by the force of the second spring 44 into the check storage pocket 12.

The distal end 24*d* of the first arm 24*b* of the first pressure lever 24, which is pivotally urged by the first spring 27, also presses against the back receiving part 32 of the first arm 30*a* of the second pressure lever 30.

The force of first spring 27 is thus transferred through the first pressure lever 24 to the second pressure lever 30, and this force causes the second pressure lever 30 to rotate to the closed position. The directions in which the first pressure lever 24, second pressure lever 30, and paper shift lever 40 are rotationally urged by the first spring 27 and second spring 44 are indicated by arrows Y1, Y2, and Y3 in FIG. 8.

As shown in FIG. 5, the paper guide 60 can move between a guide position where the paper guide 60 diagonally intersects the paper transportation path L2 of a check S1 conveyed by the discharge roller unit 20, and an open position where the paper guide 60 does not intercede in the paper transportation path L2 of the check S1. When the paper guide 60 is in the open position, the paper guide 60 is set to a pressure position where pressure can be applied to checks S1 stacked in the check storage pocket 12.

As shown in FIG. 8, the paper guide 60 rises up from the pivoting end side of the rocking lever 61 disposed below the bottom 12A. The rocking lever 61 is supported pivotally through a horizontal plane on the frame 11 by a pin 62, and is thus supported movably between the guide position described above and an open position (pressure position). To appropriately regulate the range of circular movement of the rocking lever 61, a pin 64 that slidably engages a curved channel 63 in the rocking lever 61 projects from the frame 11.

When the paper guide 60 moves to the guide position, the paper guide 60 diagonally intercepts the paper transportation path L2 and thus functions to guide a check S1 into the check storage pocket 12 when the leading edge of a check S1 advanced from the discharge roller unit 20 contacts the paper guide 60.

After the check S1 discharge operation is completed, the paper guide 60 pivots from the guide position to the open position, and thus functions to press the checks S1 stacked in the check storage pocket 12 to the side wall 12C (pressure member 15) side.

A third spring 65 (first urging member) forming a paper guide moving mechanism is disposed between the rocking lever 61 and frame 11 to drive the paper guide 60. This third spring 65 rotationally urges the rocking lever 61 in the direction of arrow Y4 in FIG. 8, that is, in the direction displacing the paper guide 60 from the guide position to the open position, thereby returning the rocking lever 61 to the check guide position in resistance to the force of the third spring 65 as a result of the distal end of the second arm 30*b* of the second pressure lever 30 engaging the engaging part 66 of the rocking lever 61. The position of the paper guide 60 thus changes according to the rotational position of the second pressure lever 30.

When the solenoid 26 is energized and operated to turn the first pressure lever 24 counterclockwise (opposite arrow Y1) in this paper storage apparatus 10, the second pressure lever 30 turns clockwise (opposite arrow Y2) as a result of the force of the third spring 65 applied thereto by the intervening rocking lever 61, and the receiving portion 34 of the pivoting second pressure lever 30 rotationally urges the paper shift lever 40 counterclockwise (opposite arrow Y3) by way of intervening engagement pin 43.

Figure 12:
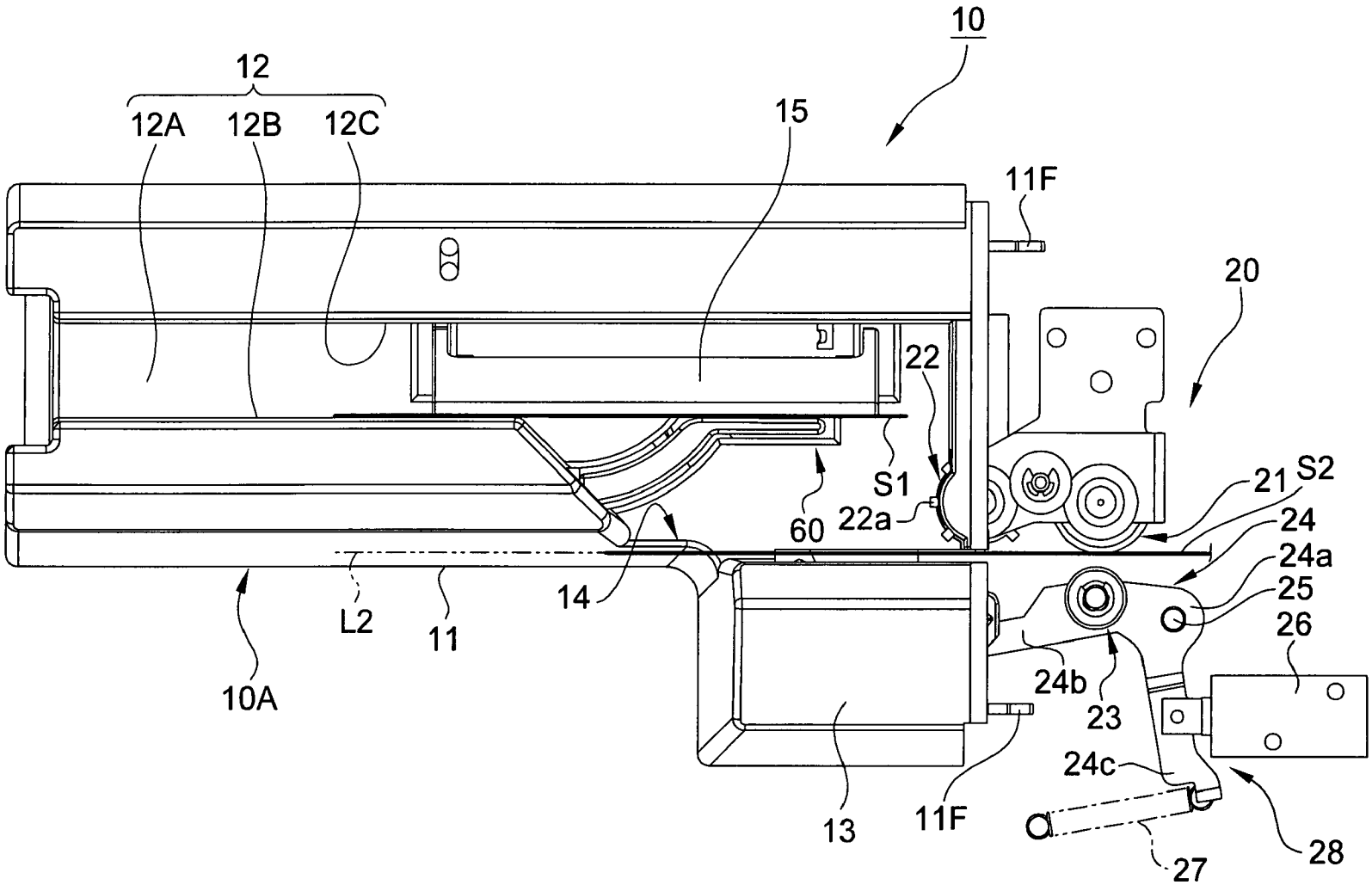
FIG. 12 is a plan view of the paper storage apparatus when paper is stored in the storage pocket.
Figure 13:
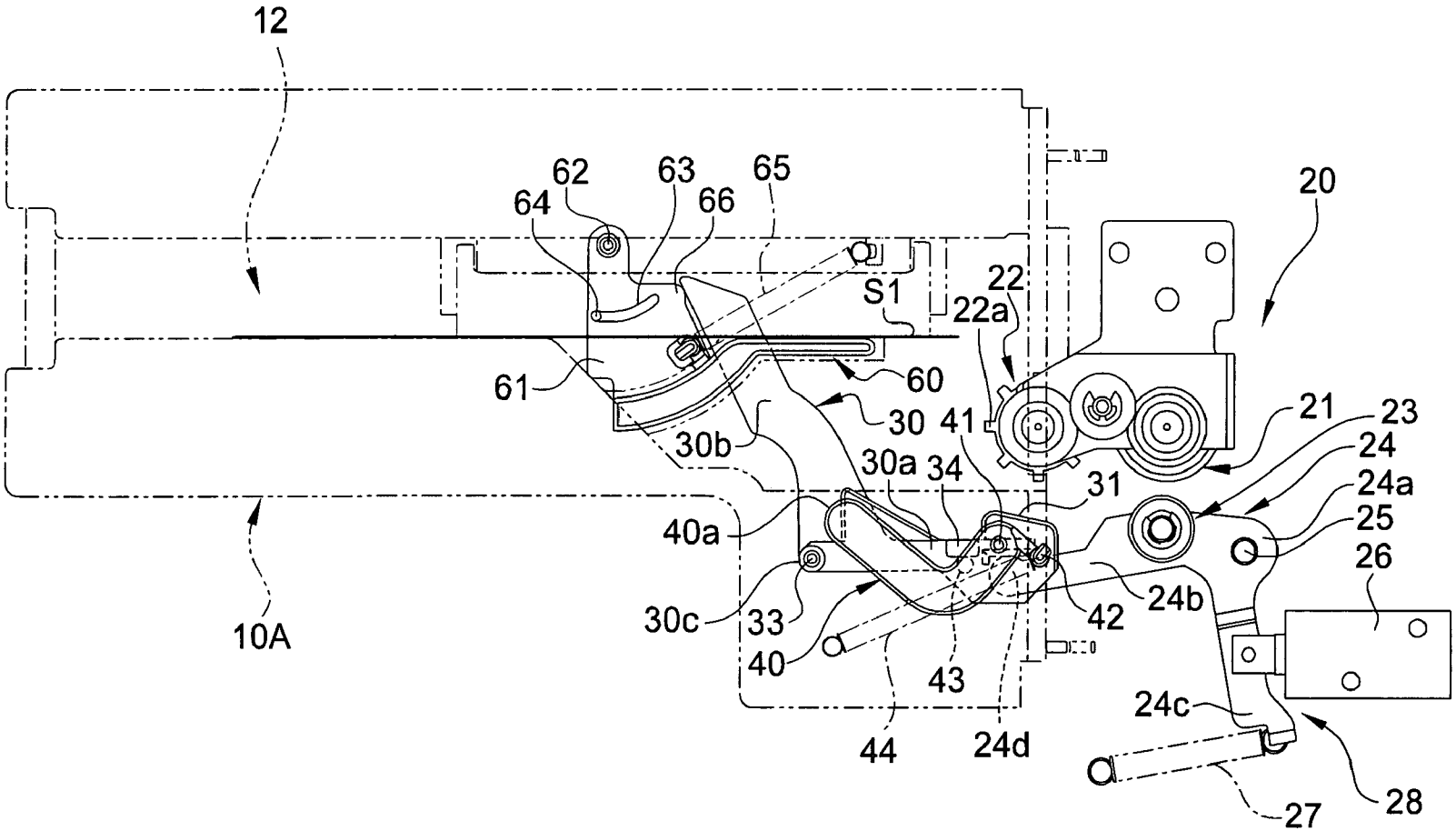
FIG. 13 is a plan view showing the internal configuration of the paper storage apparatus.
Figure 14:
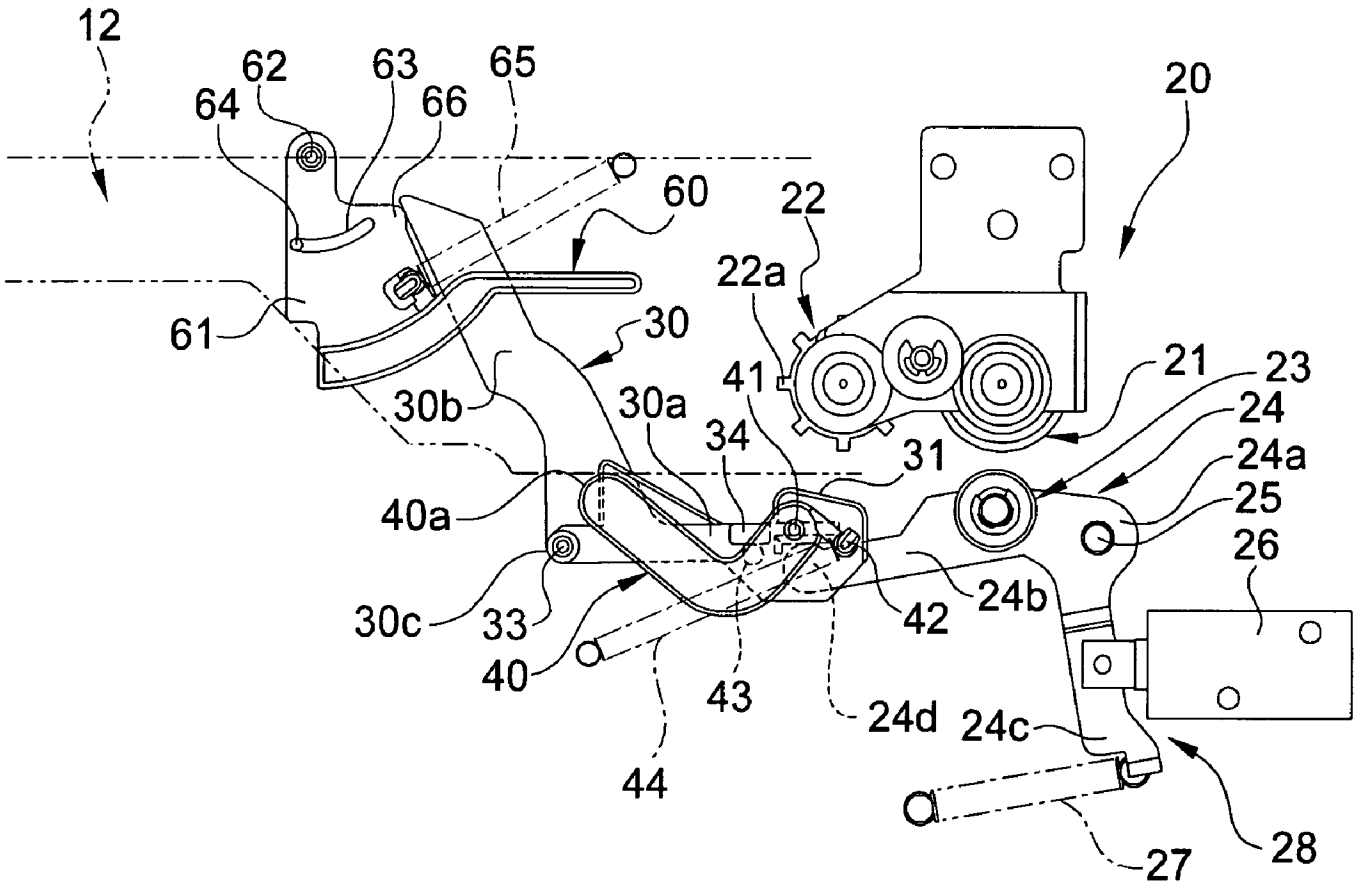
FIG. 14 is an enlarged plan view of the paper storage apparatus.

As a result of this operation of the paper storage apparatus 10, the pressure roller 23 separates from the first discharge roller 21 and the paper presser 31 separates from the second discharge roller 22 as shown in FIG. 12 and FIG. 13, the distal end 40*a* of the paper shift lever 40 retracts from the paper transportation path L2, and the paper guide 60 simultaneously moves from the guide position to the open position. The notch 14 thus opens, and the paper transportation path L2 is opened in a straight path.

Operation of the paper presser 31 and second discharge roller 22 is described next with reference to FIG. 15A and FIG. 15B.

Figure 15A:
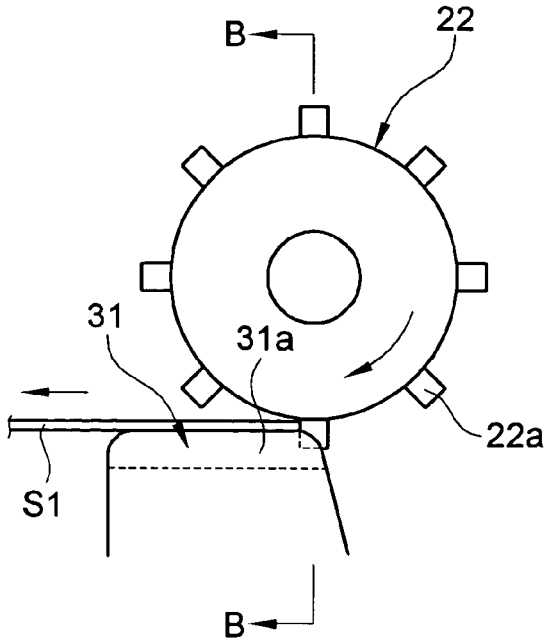
FIG. 15A is a plan view showing the relationship between the second discharge roller and paper pressure unit in the paper storage apparatus.
Figure 15B:
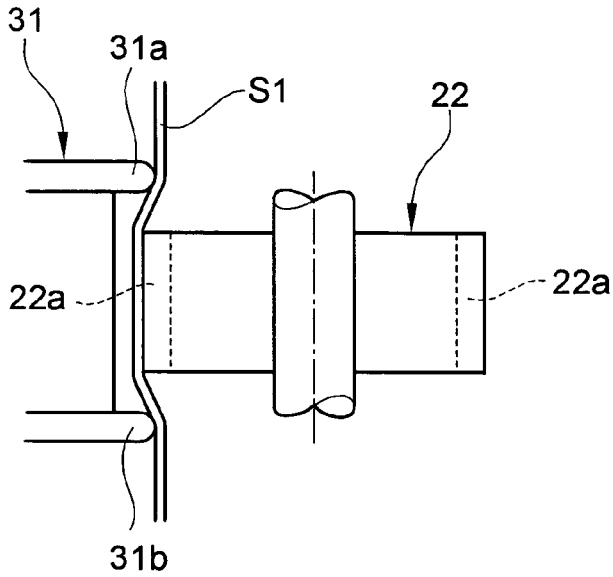
FIG. 15B is a section view through line B-B in FIG. 15A.

As shown in FIG. 15A, a plurality of ribs 22*a* is disposed with a specific interval therebetween in the circumferential direction on the rotational surface of the second discharge roller 22. Further, as shown in FIG. 15B, a pair of vertically separated pressure walls 31*a*, 31*b* project from the end of the paper presser 31 so that when the paper presser 31 is in the paper pressing position (the second pressure lever 30 is in the closed position), the ribs 22*a* on the outside of the second discharge roller 22 fit between the upper and lower pressure walls 31*a*, 31*b*. The check S1 is thus held between the ends of the upper and lower pressure walls 31*a*, 31*b* and the outside edge of the ribs 22*a*, and the check S1 can be conveyed while curved between the pressure walls 31*a*, 31*b* as shown in FIG. 15B.

When the trailing edge of the check S1 reaches this area between the pressure walls 31*a*, 31*b* and is then released by the ribs 22*a*, the check S1 returns to the straight posture. As shown in FIG. 15A, the trailing edge of the check S1 is then caught by the side of a rib 22*a*, and the check S1 is conveyed by the rotating rib 22*a* pushing directly on the trailing edge of the check S1 rather than by friction.

Operation of the paper storage apparatus 10 is described next.

As shown in FIG. 5, when a check S1 is delivered from the discharge roller unit 20, the leading edge of the check S1 contacts the side of the paper shift lever 40.

Figure 9:
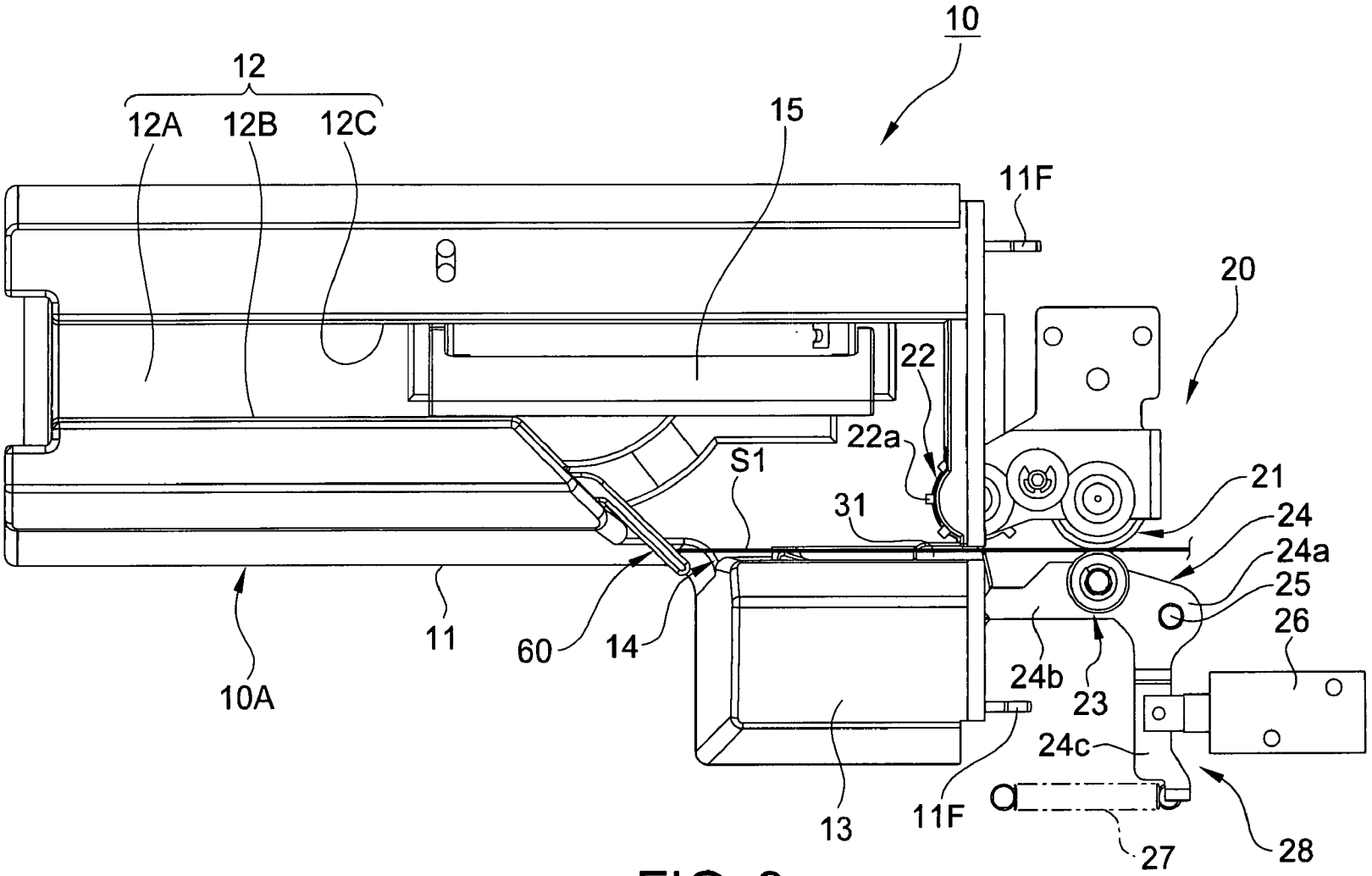
FIG. 9 is a plan view of a paper storage apparatus showing a paper is in contact with the paper guide.

As shown in FIG. 9, the paper shift lever 40 pushed by the leading edge of the check S1 pivots counterclockwise as seen in the figure in resistance to the force of the second spring 44, and retracts to the position allowing the check S1 to advance.

The discharge roller unit 20 can thus advance the check S1 smoothly without interference even though the paper shift lever 40 is disposed in line with the paper transportation path L2 on the exit side of the discharge roller unit 20.

As shown in FIG. 10, the leading edge of the check S1 contacts the paper guide 60 diagonally intersecting the paper transportation path L2, and the check S1 is guided into the check storage pocket 12, which is positioned offset from the paper transportation path L2.

Further, when the trailing edge of the check S1 conveyed by the discharge roller unit 20 is released from the discharge roller unit 20, the check S1 is no longer supported (nipped) by the discharge roller unit 20. As a result, the paper shift lever 40 is pivoted clockwise as seen in the figure by the force of the second spring 44, and the trailing edge of the check S1 is urged into the check storage pocket 12. Because the trailing edge of the check S1 is pushed by the ribs 22*a* of the second discharge roller 22 at this time, after the trailing edge advances to a position completely freed from the discharge roller unit 20, the check S1 is urged to the check storage pocket 12 side by the distal end 40*a* of the paper shift lever 40.

Because this urging by the paper shift lever 40 repeats each time a check S1 is advanced by the discharge roller unit 20, when the leading edge of the next check S1 is advanced by the discharge roller unit 20, the trailing edge of the previous check S1 will not remain in the path of the next check S1 and will therefore not interfere with the advancement of the next check S1.

Therefore, even if a check is somewhat folded or wrinkled, successive checks can be collected smoothly in the check storage pocket 12 without becoming tangled or jammed, and the order of the stacked checks will not change from order in which the checks were processed.

Furthermore, by energizing and driving the solenoid 26 when discharging a check S1 is completed, the first pressure lever 24 can be pivoted counterclockwise as shown in FIG. 12 and FIG. 13, and the discharge roller unit 20 will be opened.

The second pressure lever 30 thus turns clockwise as a result of the force of the third spring 65 received through intervening rocking lever 61, and the receiving portion 34 of the pivoted second pressure lever 30 rotationally urges the paper shift lever 40 counterclockwise by way of engagement pin 43. The paper shift lever 40 therefore also moves to the retracted position. The paper guide 60 also moves from the check guide position to the open position as a result of the rocking lever 61 being rotationally urged counterclockwise by the force of the third spring 65. The bundle of checks S1 collected in the check storage pocket 12 is then held firmly together and prevented from separating by the pressure member 15, paper guide 60, and side wall 12B.

Furthermore, by changing the discharge roller unit 20, paper shift lever 40, and paper guide 60 to the open position, a wide slip S2 can be inserted from the top opening 7 to the second transportation path 6 without interference from the discharge roller unit 20, paper shift lever 40, or paper guide 60.

In addition, because the operation of the release mechanism 28 changing the discharge roller unit 20 and paper shift lever 40 to the open position is linked to the movement of the paper guide 60, all members (specifically 24, 30, 40, and 60) can be operated using only one solenoid 26 on the main unit 1 side.

A preferred embodiment of the present invention has been described above with reference to the accompanying figures, but the invention shall not be limited to the foregoing embodiment and can be varied in many ways without departing from the scope of the accompanying claims based on the accompanying claims, the detailed description of the invention, and the literature.

Figure 16A:
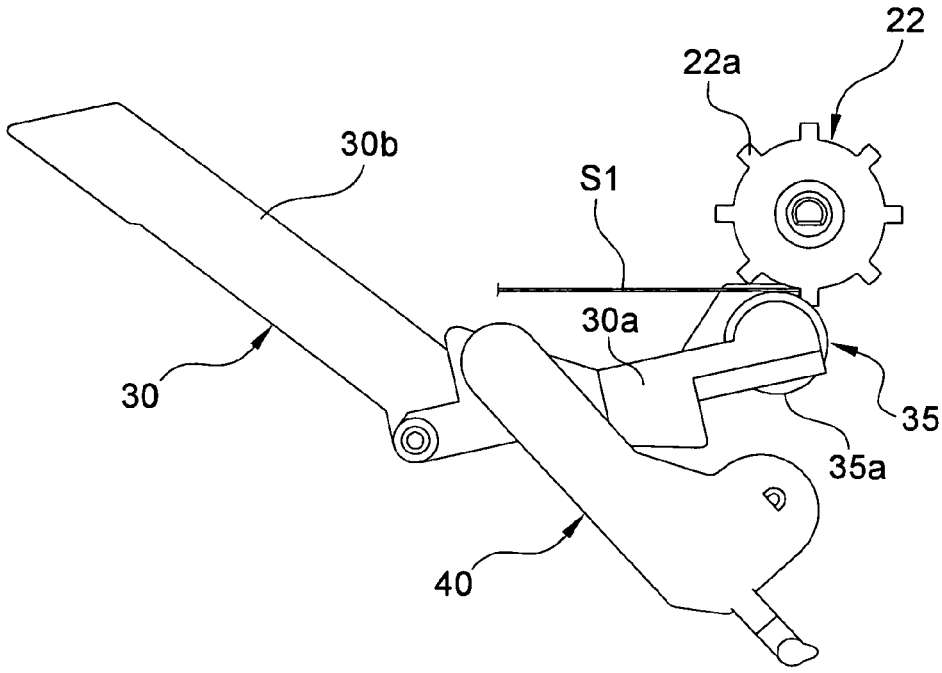
FIG. 16A is a plan view showing the relationship between the second discharge roller and paper pressure unit in the paper storage apparatus according to another embodiment of the invention.
Figure 16B:
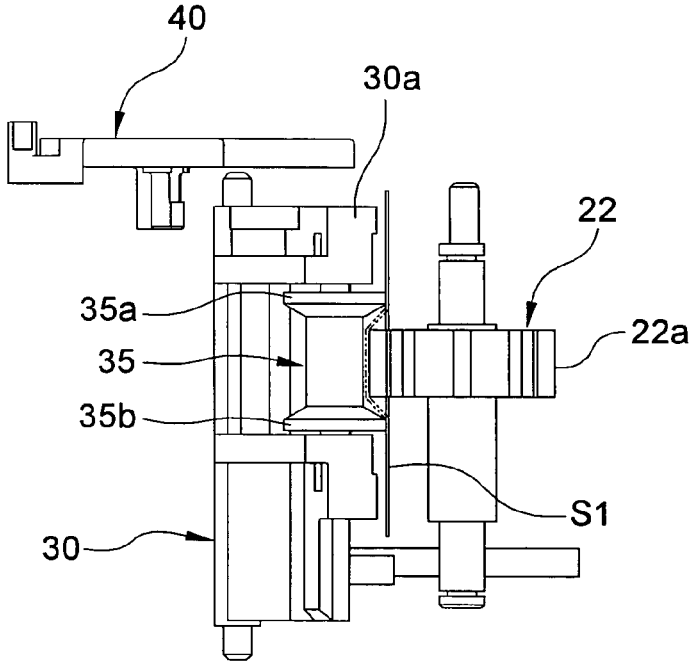
FIG. 16B is a side view showing the relationship between the second discharge roller and paper pressure unit in the paper storage apparatus shown in FIG. 16A.
Figure 17:
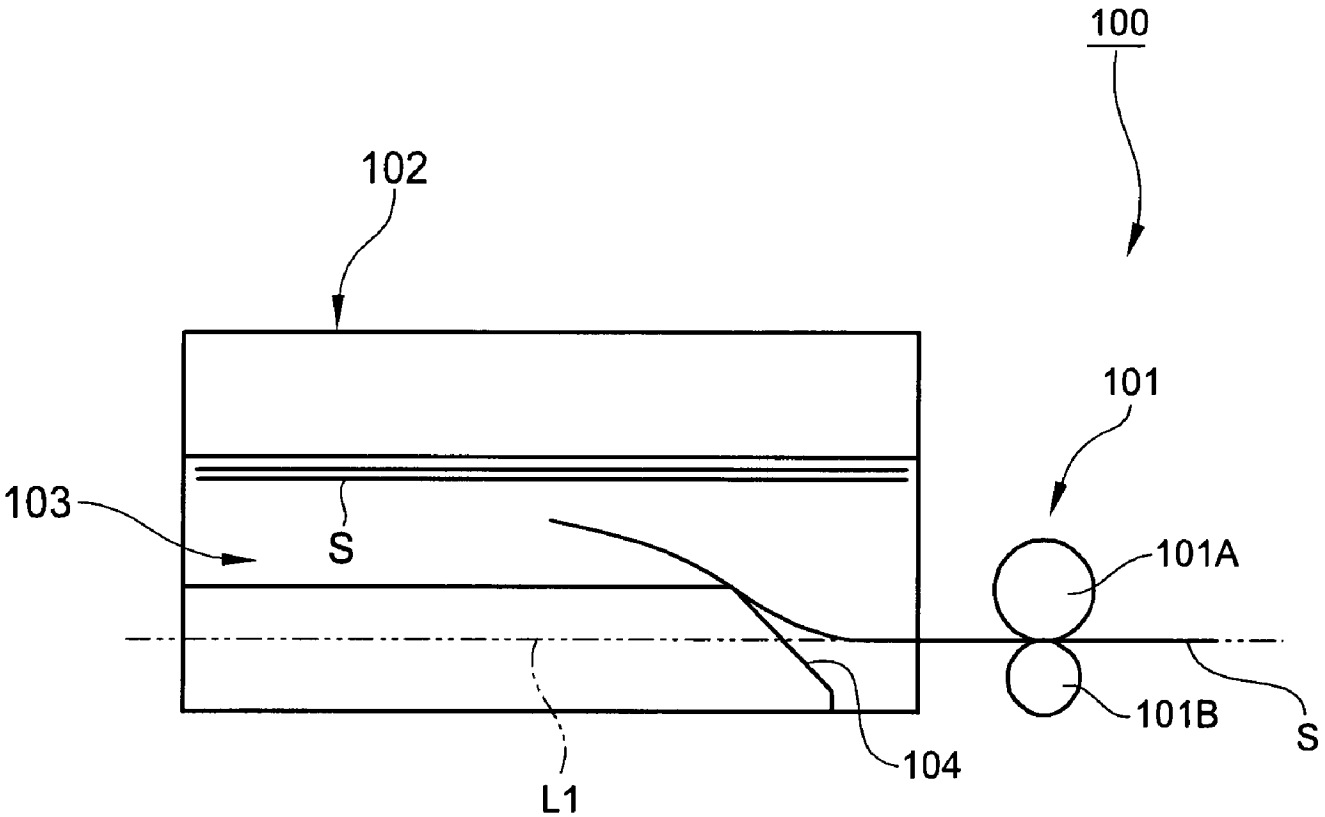
FIG. 17 is a plan view of a paper storage apparatus typical of the prior art.

For example, a paper presser 31 is disposed to the pivoting distal end of the first arm 30*a* of the second pressure lever 30 in order to urge checks S1 to the second discharge roller 22 in the foregoing embodiment, but the invention shall not be so limited as the same effect can be achieved by means of a paper pressure roller 35 disposed freely rotationally on the distal end of the first arm 30*a* of the second pressure lever 30 as shown in FIG. 16A and FIG. 16B.

This paper pressure roller 35 has a pair of flanges 35*a*, 35*b* on opposite ends of a cylindrical roller. When the paper pressure roller 35 is in the paper pressing position (the second pressure lever 30 is in the closed position), the ribs 22*a* of the second discharge roller 22 fit between the flanges 35*a*, 35*b*. By holding a check S1 between the pair of flanges 35*a*, 35*b* and the distal edge of the ribs 22*a*, a check S1 can be conveyed while held deformed between the flanges 35*a*, 35*b* as indicated by the imaginary line in FIG. 16B.

When the trailing edge of the check S1 reaches this position and is released from being pressed between the flanges 35*a*, 35*b* by the ribs 22*a*, the check S1 recovers from this deformed position to the normal straight position. The trailing edge of the check S1 is then caught by the side of the rib 22*a* as shown in FIG. 16A, and the check S1 can be conveyed by the rotating rib 22*a* pushing directly on the trailing edge of the check S1 rather than by friction.

By thus using a freely rotating paper pressure roller 35 to press the check S1 to the second discharge roller 22, less torque is required to stably convey a check S1 when compared with a stationary paper presser 31 applying pressure to the check S1 because the, loss of transportation force due to friction with the check S1 is less.

Furthermore, the paper storage apparatus 10 has been described in the foregoing embodiment using a paper guide moving mechanism for moving the paper guide 60 between a paper guide position and a paper pressure position, and a paper shift lever 40 that operates simultaneously linked to the operation of the paper guide 60. The invention shall not be so limited, however, as only one of the paper guide moving mechanism and paper shift lever could be provided.

Furthermore, a paper storage apparatus 10 is described in the foregoing embodiment as rendered in a document processor P having both a data reader 3 and a printer 4, but this paper storage apparatus 10 could be rendered to a facsimile, photocopier, or other type of paper processing apparatus.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A paper storage apparatus, comprising:

a first discharge roller for discharging paper in a given discharge direction;

a paper storage pocket for storing discharged paper, the paper storage pocket being positioned at a location offset from the given discharge direction;

a moveable first guide member having a first position in which the first guide member is disposed at an inclined angle relative to the given discharge direction for guiding the paper into the paper storage pocket and having a second position for applying pressure to the paper in the paper storage pocket; and a moveable second guide member positioned between the first discharge roller and the first guide member, the second guide member having a substantially upright position in which the second guide member intersects the given discharge direction and a retracted position, the second guide member being configured to (i) pivot toward its retracted position as a leading edge of the paper contacts the second guide member and the paper advances past the second guide member and (ii) return to its substantially upright position after a trailing edge of the paper passes the second guide member, urging the paper toward the paper storage pocket.

2. The apparatus of claim 1, further comprising:

a first pressure member disposed opposite the first discharge roller, the first pressure member being moveable between a pressure position for pressing the paper to the first discharge roller and a retracted position separated from the first discharge roller; and a linking mechanism for urging the first guide member to its first position and the second guide member to its substantially upright position when the first pressure member is in its pressure position, and for urging the first guide member to its second position and the second guide member to its retracted position when the first pressure member is in its retracted position.

3. The apparatus of claim 2, wherein the linking mechanism comprises:

a first urging member for urging the first guide member toward its second position;

a second urging member for urging the second guide member toward its substantially upright position; and a first lever member having a first arm that contacts the first guide member, a second arm that contacts the second guide member, and a pivot about which the first and second arms pivot;

wherein, in conjunction with the first lever member pivoting in a first direction, the first guide member is moved to its first position and the second guide member is moved to its substantially upright position; and wherein, in conjunction with the first lever member pivoting in a second direction, opposite the first direction, the first guide member is moved to its second position and the second guide member is moved to its retracted position.

4. The apparatus of claim 3, wherein the linking mechanism further comprises a second lever member having a third arm that contacts the second arm of the first lever member, a fourth arm linked to an actuator, and a pivot about which the third and fourth arms pivot, wherein the first pressure member is supported by the third arm, such that (i) when the first lever member pivots in the first direction and the second lever member pivots in a third direction, the first pressure member is moved to its pressure position; and (ii) when the first lever member pivots in the first direction and the second lever member pivots in a fourth direction, opposite the third direction, the first pressure member is moved to its retracted position.

5. The apparatus of claim 3, further comprising:

a second discharge roller located downstream of the first discharge roller and having a plurality of ribs on an outer circumferential surface thereof; and a second pressure member disposed on the second arm of the first lever member and movable to a position opposite the second discharge roller when the first lever member pivots in the first direction.

6. The apparatus of claim 5, wherein the second pressure member has flanges defining a space therebetween with which the ribs of the second discharge roller engage when the second pressure member is positioned opposite the second discharge roller.

7. The apparatus of claim 1, further comprising a second discharge roller located downstream of the first discharge roller and having a plurality of ribs on an outer circumferential surface thereof.

8. The apparatus of claim 1, wherein the paper storage pocket comprises:

mutually opposing first and second side walls positioned substantially parallel to the given discharge direction, the second side wall being positioned closer to the given discharge direction than the first side wall;

a bottom wall joining the first and second side walls; and a paper support member disposed between the first and second side walls and urged toward the second side wall;

wherein paper stored in the paper storage pocket is held between the paper support member and the first guide member in its second position.

9. A paper processing apparatus, comprising:

a first transportation path;

a first discharge roller for discharging paper in a given discharge direction along the first transportation path;

a paper storage pocket for storing discharged paper, the paper storage pocket being positioned at a location offset from the given discharge direction;

a moveable first guide member having a first position in which the first guide member is disposed at an inclined angle relative to the given discharge direction for guiding the paper discharged by the first discharge roller into the paper storage pocket and having a second position for applying pressure to the paper in the paper storage pocket;

a moveable second guide member positioned between the first discharge roller and the first guide member, the second guide member having a substantially upright position in which the second guide member intersects the given discharge direction and a retracted position, the second guide member being configured to (i) pivot toward its retracted position as a leading edge of the paper contacts the second guide member and the paper advances past the second guide member and (ii) return to its substantially upright position after a trailing edge of the paper passes the second guide member, urging the paper toward the paper storage pocket;

a first pressure member disposed opposite the first discharge roller, the first pressure member being moveable between a pressure position for pressing the paper to the first discharge roller and a retracted position separated from the first discharge roller;

a linking mechanism for urging the first guide member to its first position and the second guide member to its substantially upright position when the first pressure member is in its pressure position, and for urging the first guide member to its second position and the second guide member to its retracted position when the first pressure member is in its retracted position; and a second transportation path for receiving paper;

wherein the first and second transportation paths are substantially perpendicular and intersect near the first discharge roller; and wherein, when inserting paper into the second transportation path, the first pressure member is set to its retracted position, the first guide member is set to its second position, and the second guide member is set to its retracted position by the linking mechanism.

10. The paper processing apparatus of claim 9, wherein:

the first discharge roller and the first pressure member are disposed on a paper processing side of the apparatus; and a paper storage unit that includes the paper storage pocket and the first and second guide members is removably mounted to the apparatus.

* * * * *